United States Patent [19]

Monia

[11] 4,006,275

[45] Feb. 1, 1977

[54] MATERIAL FOR, AND METHOD OF FORMING, TUBULAR WALLS FOR PRODUCT CONTAINERS

[75] Inventor: Victor Monia, San Jose, Calif.

[73] Assignee: Guardian Packaging Corporation, Newark, Calif.

[22] Filed: Sept. 25, 1974

[21] Appl. No.: 509,013

Related U.S. Application Data

[62] Division of Ser. No. 290,781, Sept. 21, 1972, Pat. No. 3,859,154.

[52] U.S. Cl. ..... 428/36; 222/92; 242/7.21; 428/195; 428/200

[51] Int. Cl.[2] ..... B65D 35/00

[58] Field of Search ..... 93/35 R, 40; 117/37 R, 117/38; 156/184, 187, 188, 194, 195, 198, 215, 217, 218, 272, 277; 161/3, 145; 222/92, 107; 242/7.21; 427/256, 282; 283/18, 21, 51, 52, 53, 61, 62; 428/33, 35, 36, 43, 195, 200, 211

[56] References Cited

UNITED STATES PATENTS

| | | | |
|---|---|---|---|
| 2,269,661 | 1/1942 | Gurwick | 161/145 |
| 2,293,054 | 8/1942 | Freedman | 283/53 |
| 2,682,974 | 7/1954 | Smith | 222/107 |
| 3,347,419 | 10/1967 | Brandt et al. | 222/107 |
| 3,755,934 | 9/1973 | Porcher et al. | 40/2 F |

*Primary Examiner*—Thomas J. Herbert, Jr.
*Assistant Examiner*—Bruce H. Hess
*Attorney, Agent, or Firm*—C. Michael Zimmerman

[57] ABSTRACT

A material and method of forming it into tubular wall structures for product dispensing tubes is described. The material is a continuous web which is printed on one side with a succession of two different advertisement messages it is desired to appear on two different dispensing tubes. Such messages are printed in alternately repeating sequence along the length of the material so that the material can be thought of as being divided lengthwise into repeating sections, each one of which includes both advertising messages. Each of such sections is generally twice as long as the outer circumference desired for the dispensing tube, with each portion having a different message thereon taking up one-half of the section so that each of such portions has a length generally equal to such desired outer circumference. The method includes the steps of separating one of such sections from the remainder of the material when it is desired to form a tubular structure for a dispensing tube. The removed section is then convolutely wound lengthwise into tubular form from its end opposite that end having the advertising message it is desired to appear on the exterior of the tube. Such section is wound through 720° to provide a double wrapping of such material with the desired message on the exposed, exterior surface of the finished tube and the other message covered over. Thus, dispensing tubes having either one of two different messages, as desired, can be produced from the same roll of web material.

3 Claims, 8 Drawing Figures

MATERIAL FOR, AND METHOD OF FORMING, TUBULAR WALLS FOR PRODUCT CONTAINERS

This is a division of application Ser. No. 290,781, filed Sept. 21, 1972, and now U.S. Pat. No. 3,859,154, issued Jan. 7, 1975.

BACKGROUND OF THE INVENTION

The present invention relates to tubular walls for product containers and, more particularly, to the formation from a single sheet of material of a tubular structure having any one of a plurality of different indicia on its exterior surface.

It is becoming increasingly common to make the tubular walls for collapsible dispensing containers of the type used, for example, to package toothpaste, from laminated sheet material. Most often, the laminated material is supplied to the tube manufacturer as an elongated, continuous web of such material which is convolutely wound into a large roll. The tubes are manufactured from the material by appropriate machinery which unwinds the roll and slices the material, as needed, into appropriately sized portions which are then formed into the desired tubes. Typically, the web of material is preprinted with whatever advertising message and directions it is desired to appear on the tubular wall. The portions cut from the web for each of the tubes is then appropriately chosen to properly place the advertising message and other indicia on the finally formed tubular structure.

Although in general it is easier and much more economical to preprint a web of material as set forth above prior to it being formed into the individual tubular structures, such method is not entirely satisfactory. For one thing, it is not unusual for a manufacturer of a product to want to package the product in containers which are identical except for relatively minor differences in the advertising message or other indicia which is applied to the container. For example, several large dentifrice manufacturers sell both "plain" and "flavor containing" dentifrices under single trademarks. Often this difference in products is reflected on the dentifrice tubes as only a color change and slightly different wording in the advertising messages. Moreover, some manufacturers market dentifrices and the like under several different trademarks, the use of each of which requires different printing on the separate containers.

It will be appreciated that if a tube manufacturer wishes to be in a position to quickly respond to orders from a product manufacturer for containers having different messages, he must maintain in stock separate rolls of the web material having such different messages. Because the web rolls are relatively large, the storage of very many different kinds requires an appreciable amount of space. Thus, the necessity of keeping a plurality of rolls having the different messages respectively printed thereon adds to the expense of a tube manufacturer's operation. It will also be appreciated that the printing of different messages on the separate rolls adds to the expense of manufacturing the laminated web material, especially since the major cost of a printing operation is in the set-up time for each individual printing run and the different printing cylinders which are required for each.

SUMMARY OF THE INVENTION

The present invention enables differently printed tubular structures for containers to be formed from the same roll of product packaging web material, thus eliminating the necessity of a tube manufacturer maintaining on hand separate web rolls for each tubular structure for which he can expect an order. The present invention accomplishes this while at the same time reducing the overall expense of printing the messages on the web material. To these ends, the invention includes a sheet of material which has the different messages relating to the different products to be packaged printed on it, and a method of forming tubular structures therefrom which results in the desired one of the messages appearing on the exterior surface of the finished tubular structure. The sheet of material includes a section for each tube to be manufactured which has the different indicia messages applied on one side surface of it in succeeding portions of such section. Each differently printed portion of the section has a length which is generally equal to the outer circumference desired for the final tubular structure.

The method of forming a tubular structure having the selected indicia on its exterior surface includes the steps of providing a sheet of material and applying the different indicia messages on succeeding portions of the section as stated above. Such section is then separated from the remainder of the material in such a manner that the portion of the section having the selected message is at one end of such section. The section is then convolutely wound lengthwise into the desired tubular form for the tubular structure, beginning from the end of it opposite the end having the selected indicia. As a particularly salient feature of the method, the section is not only wound in a direction placing the indicia surface on the exterior side of the rolled form, but for a number of wrappings generally equal to the number of the different messages in the section. The result is that the portion of the rolled section which has the desired message on it forms the exposed, exterior surface of the tubular structure, while the other portions of the section having indicia are covered. Most desirably, the various wrappings of the section forming the tubular structure are sealed together to provide the tubular structure with a unitary tubular wall.

It is recognized that the method of the invention requires a greater length of the material to be used for each individual tubular wall than is used for a tubular wall formed by wrapping the material only through 360° to form a single wrapping wall. However, the cost of this increased material length can be offset by the utilization of fewer plies or less thick plies to make the material. That is, since the tubular wall will be made up of a plurality of adjacent wrappings of the material, each wrapping used need not be as thick. Moreover, it should be noted that in order to minimize overlapped joint thickness, among other reasons, some tube manufacturers already utilize a double wrapping, i.e., a wrapping of the material through 720°, in forming the tubular wall for collapsible dispensing tubes. The invention is particularly applicable for use by such manufacturers. Such a manufacturer can halve the number of differently printed web rolls he must maintain in stock, merely by obtaining web rolls printed with two different messages in accordance with the invention and adjusting his tube manufacturing equipment to separate the material for each tube at the appropriate location so that upon it being wound through 720°, the selected indicia will be on the exposed, exterior surface of the finished tubular structure.

As mentioned previously, the cost of printing the different messages or, more broadly stated, indicia is also lowered by the invention. More particularly, it will be recognized that only one set-up operation is required to print the different indicia on the same number of web rolls which have been printed in the past with the different indicia. Moreover, since the printing cylinders and the like useable with one message may be the same as used for another, when the printing of the different messages are combined, the total number of such rolls which are required can be reduced.

The invention includes other features and advantages which will become apparent from the following more detailed description of a preferred embodiment.

BRIEF DESCRIPTION OF THE DRAWING

With reference to the accompanying single sheet of drawing.

DETAILED DESCRIPTION OF THE PREFERRED EMBODIMENT

Figure 1:
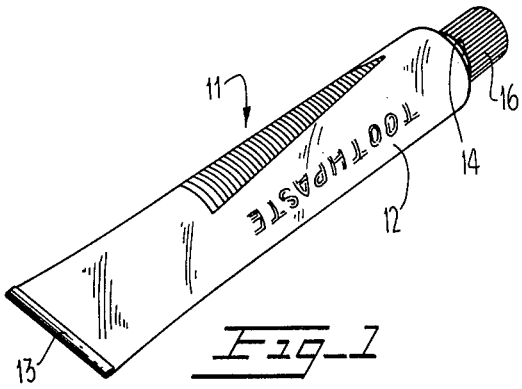
FIG. 1 is a perspective view of a collapsible dispensing container of the type for which the present invention is particularly applicable.

With reference to the drawing, FIG. 1 illustrates a product container of the type to which the present invention is particularly applicable. Such container, generally referred to by the reference numeral 11, is a so-called collapsible dispensing container, i.e., squeeze tube, of the type often used to package dentifrices, pharmaceuticals and cosmetics. The tube 11 includes a tubular wall structure 12 which is closed at one end 13 by, for example, having diametrically opposed sides of the tubular wall heat sealed together. Most often, such end is closed after the tube is filled with the desired product. A head piece 14 closes the tube at its other end and includes an exteriorly threaded neck portion over which is secured a cap 16. As will be recognized, a consumer removes a desired amount of the product from the tube by removing the cap 16 and then squeezing the tube to dispense such product out of the uncovered neck portion.

As discussed previously, more and more tubes of this type are being manufactured from laminated sheet material. The laminated material generally includes at least one impermeable ply, such as of a metal foil, to assure that the product remains completely separated from the atmosphere. The impermeable ply is generally sandwiched in the laminate between thermoplastic plies, such as plies of polyethylene. The labeling indicia it is desired to have on the dispensing tube, such as advertising and direction messages, are then printed on one side of the laminate and, most often, a protective ply is applied thereover.

The laminated material is generally made as a continuous web of material which is convolutely wound into a large roll to facilitate handling and storage. Typically, the web has a width of about three feet and a diameter of about 1½ feet. The labeling indicia for individual ones of the tubes is printed both widthwise and lengthwise of the web. The web is then sliced longitudinally to provide elongated webs having a plurality of tube messages printed in column fashion along the length of the material. Such elongated webs are then supplied separately to a tube making machine which slices appropriate lengths of the material from the web and rolls it into the desired tube form with the printing on its exterior.

As also discussed previously, it is common for a product manufacturer to market various ones of his products in identical tubes, except for the printing. This has meant that tube manufacturers have had to maintain in stock rolls of the tube material which differ from one another only in the printed message relating to the particular product to be packaged in the finished tube. The result is that a large inventory of web material must be kept on hand by the tube manufacturer if he wishes to be in a position to promptly fill orders for tubes with differing messages.

Figure 2:
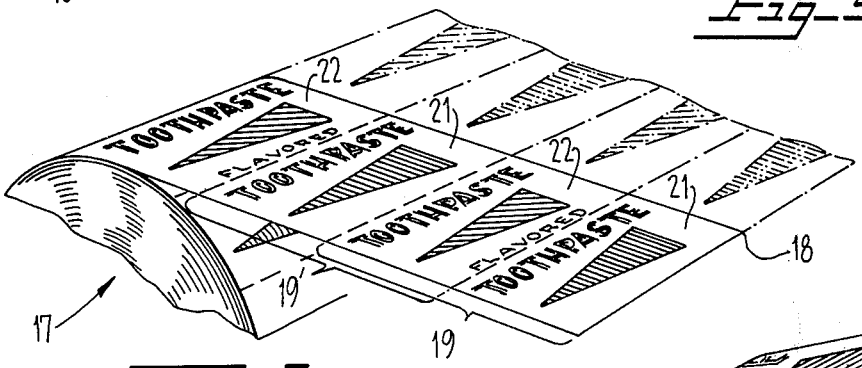
FIG. 2 is a partial and reduced in size perspective view of a roll of web material having two different indicia printed on succeeding portions thereof.

The present invention enables the same web of material to be utilized to produce tubular structures for dispensing tubes having any selected one of a plurality of different messages. The invention accomplishes this while at the same time reducing the overall printing cost. FIG. 2 illustrates a portion of a roll, generally referred to by the reference numeral 17, of continuous web material of a preferred embodiment of the invention particularly adapted for the manufacture of tubes having two respectively different messages applied thereto. As shown, one side of the material 18 from the roll 17 is printed with the two different messages in alternately repeating sequence along its length. That is, the web can be thought of as divided into a plurality of sections 19 or 19', each of which includes two succeeding portions 21 and 22 (or 22 and 21) having different messages printed thereon for respectively different products. For example, the message on portion 21 is shown as one designed for a dispensing tube for a plain toothpaste. In this connection, the message includes the word "toothpaste" and a dart which is denoted as having a red color. The message on the portion 22, on the other hand, is designed for a dispensing tube to package toothpastes containing a special flavor. Such message is similar to that on the portion 21 except that it includes the additional language "flavored", and the dart is denoted as green in color.

The two different messages respectively on portions 21 and 22 of each section are printed simultaneously onto the web. More particularly, the printing equipment is set up to print both at the same time, with the result that certain ones of the printing cylinders and the like which are applicable to both messages need only be provided one time. This reduces the overall cost of the printing operation.

It will be noted that the sections 19 and 19' denoted in the drawing overlap one another, i.e., the portion 22 is common to both. Thus, insofar as the term "section" is used herein, it is not to be construed as limited to discretely succeeding sections. It will also be noted from the phantom extension of the material included in FIG. 2, that each of the sections 19 and 19' is repeated widthwise of the web of material. However, most tube making equipment is only designed to handle a web of material of the width of the final tube, and thus the web is usually divided lengthwise into such widths prior to the tube manufacturing process.

Figure 3:
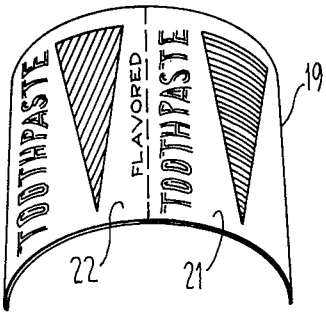
FIG. 3 is a perspective view of a section of the material having the two different indicia applied on succeeding portions thereof, which section has been separated from the roll of web material in accordance with the invention.
Figure 4:
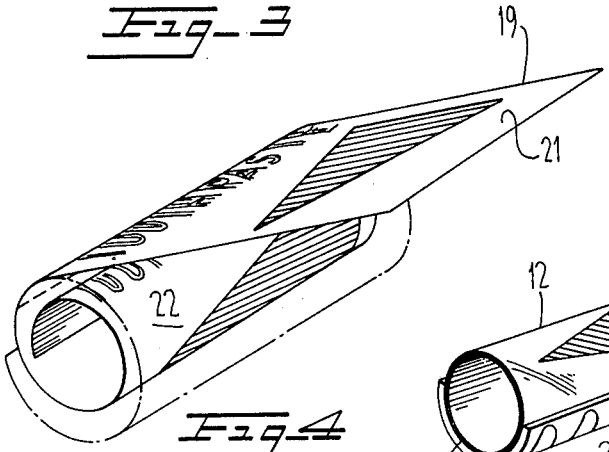
FIG. 4 is a perspective view illustrating the section of material of FIG. 3 being convolutely wound into tubular form in accordance with the invention to expose one of such indicia on its exterior surface.

For reasons which will be better understood hereinafter, each of the sections 19 and 19' is generally twice as long lengthwise of the web material as the outer circumference desired for the final tubular structure. Moreover, each of the portions 21 and 22 has a length in such direction which is equal to one-half of the length of the section, and thereby is equal in length to the circumference desired for the tube. In the manufacture of a tube with the material of the invention, having, for example, the printing on portion 21 exposed, a section 19 of the material is separated from the remainder of the material. FIG. 3 illustrates such a removed section. As shown, this section is so removed from the material that the portion 21 thereof is at its right hand end as viewed, whereas the portion 22 thereof is at its left hand end. To place the section shown in FIG. 3 into tubular form with the message on portion 21 on the exterior, it is convolutely wound into such form from the end thereof opposite the end having such portion 21. FIG. 4 illustrates the section being so convolutely wrapped. In keeping with the invention, the section of material is wound through about 720° to provide a double wrapping forming the tubular form. As can be seen from FIG. 4, this will result in the portion 22 having the unwanted printing being covered over by the portion 21. However, because each of the portions 21 has a length generally equal to the outer circumference desired for the final tubular structure, the exterior circumference of the tube will not be affected by such double wrapping.

It should be noted that since the tubular form will have a double wrapping of the material forming the tubular wall of the final dispensing tube, the material need not be and, in fact, should not be, as thick as it would be if only a single wrapping of the material were being used to make the tube. Therefore, as mentioned before, even though a greater length of material is required with use of the invention to make a tubular structure, the thickness of the material is reduced to offset this greater length.

Figure 5:
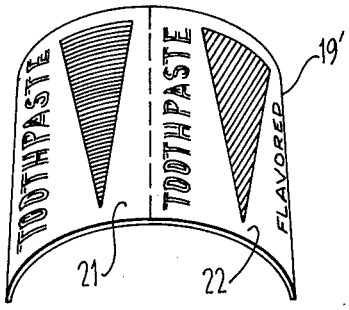
FIG. 5 is a perspective view of another section of the material having the two different indicia applied on succeeding portions thereof, which section has been separated from the roll of web material in accordance with the invention.
Figure 6:
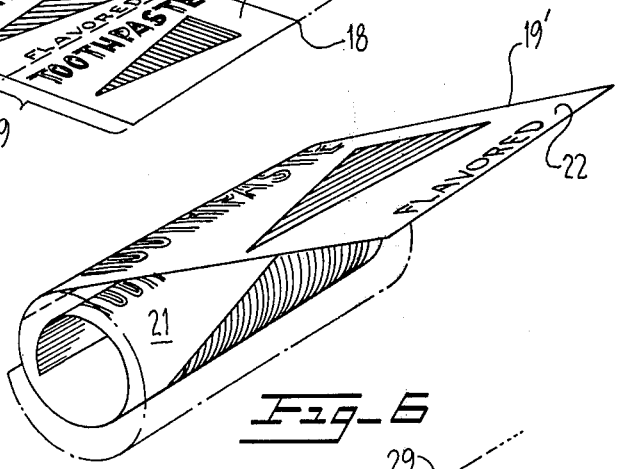
FIG. 6 is a perspective view illustrating the section of material of FIG. 5 being convolutely wound in accordance with the invention to expose the other one of such indicia on its exterior surface.

FIGS. 5 and 6 illustrate the formation of a tubular form from the section 19' so that the final tube will have the printing on portion 22 exposed. In this case, the portion 22 is on the left hand end of the section as viewed, whereas the portion 21 is now on the right hand end. Then, as can be seen from FIG. 6, upon the material being double wrapped from the end thereof opposite the end having portion 22, the exterior surface of the resulting tubular form will be defined by the portion 22. Thus, simply by choosing the appropriate section of material from the web 17 relative to the end from which it is to be wrapped into the tubular form, the desired printing will be on the exterior surface of such form.

It should be noted that although in this preferred embodiment, it is contemplated that the tube making machinery will always wrap a section of the material from the same end, i.e., the left hand end of the sections 19 and 19', the invention is also applicable to equipment capable of wrapping a section into the tubular form from either of its ends. With such equipment, it becomes unnecessary to choose different sections 19 and 19' in order to obtain the desired portions 21 and 22 on the exterior of the tube. That is, the one section 19, for example, can be wrapped from either its left or right hand end to respectively provide the portions 22 and 21 on the exterior of the tubular form.

Figure 7:
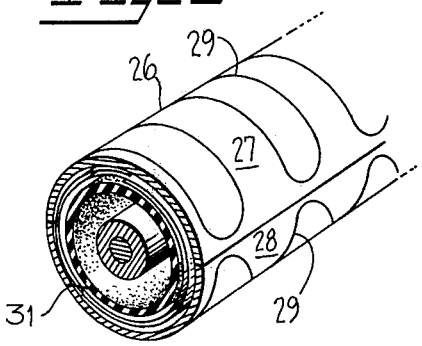
FIG. 7 is a partial perspective view illustrating the formation of a unitary, tubular wall from a tubular form provided in accordance with the invention.

After the selected tubular form represented by FIGS. 4 and 6 is generated, the resulting double wrappings or, in other words, layers, are fused together to provide the tubular structure with a unitary tubular wall. More particularly, as mentioned previously, at least one, if not both, of the sides of sheet material 18 has an exterior ply of a heat sealable material, such as of polyethylene. This enables the adjacent layers to be fused together with heat and pressure. FIG. 7 schematically illustrates apparatus for doing so. A tubular heating cylinder 26 is shown in surrounding relationship to the double wrapped material. The heating cylinder 26 is defined by two semi-cylindrical tubular halves 27 and 28 made from a heat conductive material, such as of a metal. Each of such halves is provided with electrical heating coils 29 distributed over its outer surface. With this construction, the heat generated in the coils 29 will be conducted by the cylinder to the double wrapping of material.

Figure 8:
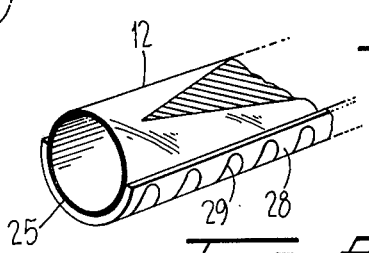
FIG. 8 is another partial perspective view of the tube forming equipment opened to expose a finished tubular structure formed in accordance with the invention.

As is conventional, pressure is applied to the double wrapping while it is heated via a balloon mandrel, the end 31 thereof being illustrated at the end of the cylinder 26. Such mandrel is made of a flexible, elastic material, and air or other gas is introduced therein to radially expand the same and thus apply pressure to the double wrapping by compressing it against the inner wall of the heating cylinder 26. Thus, heat and pressure is applied simultaneously to the material to fuse the double wrappings together and provide the desired unitary tubular structure. FIG. 8 illustrates the apparatus with both the mandrel and the upper heating cylinder half 27 removed to expose the final tubular structure.

Although the invention has been described in connection with a preferred embodiment of the material and method, it will be appreciated by those skilled in the art that various changes and modifications can be made without departing from the spirit of the invention. For one thing, the invention is equally applicable to material provided in forms other than in a web roll. Moreover, the invention is not limited to use with just laminated material, but is also applicable to single plies. And although both the material and method have been described in contemplation of it requiring a full outside wrap to cover the unwanted printing, it will be appreciated that depending on the placement of such printing, less than a full wrap will cover it. Thus, when the number of wrappings and the lengths of the sections and printed portions are specified in the specification and claims, it will be recognized that these criteria are only general criteria in keeping with the purposes of the invention.

In view of these and other changes, it is intended that the coverage afforded applicant be limited only by the terms of the claims and their equivalents.

I claim:

1. A unitary tubular wall for a product dispensing tube comprising a section of a product packaging sheet material; a plurality of different complete messages on one side surface of said section respectively in succeeding portions serially arranged along one dimension of said section, the differences between said messages relating to different information it is desired to be in a position to convey on separate product dispensing tubes and each of said succeeding portions generally being of essentially identical length as measured along said one dimension and each equal to the outer circumference of said tubular wall, said section being convolute along said dimension for a number of layers equal to the number of said different messages and with only one of said different messages on the exposed side of the exterior layer, and interior adjacent layers with the remaining ones of said different messages being permanently bonded to one another to form the unitary tubular wall.

2. The tubular wall of claim 1 wherein there are two of said succeeding portions respectively having said different messages and said section is generally twice as long as the outer circumference of said tube.

3. The unitary tubular wall for a product dispensing tube according to claim 1 to carry one product as indicated by said one message on the exposed side of its exterior layer, in combination with a second unitary tubular wall for a product dispensing tube for packaging a second product as identified by another one of said remaining ones of said different messages, with said second unitary tubular wall comprising a second section of the product packaging sheet material identical with said first mentioned section and carrying thereon the same different complete messages on one side surface of said second section respectively in succeeding portions serially arranged along the one dimension of said second section, each of said succeeding portions generally being of identical length to each other and to the portions of said first section as measured along said one dimension and each being equal to the outer circumference of said second tubular wall, said second section being convolute along said one dimension for a number of layers equal to the number of said different messages and with only one of said remaining ones of said messages different from said one message of said first section being on the exposed side of the exterior layer of said second section, and interior adjacent layers with said one message that is identical to said one message of said first section being permanently bonded to one another to form the second unitary tubular wall, whereby a packager may use said first mentioned tubular wall for a produce corresponding to said one message that is exposed and may use said second tubular wall for a different product corresponding to the exposed one of the remaining ones of said messages different from said one message.

* * * * *